US007511249B2

(12) United States Patent
Begeal et al.

(10) Patent No.: US 7,511,249 B2
(45) Date of Patent: Mar. 31, 2009

(54) ADJUSTMENT OF TEMPERATURE IN A HOT ROLLER

(75) Inventors: Carlton E. Begeal, Longmont, CO (US); Christopher Raymond Henderson, Waco, TX (US); Laurie Yoshiko Takemori, Pearl City, HI (US); John Uhlenbrock, Littleton, CO (US); Jason Cole Jackson, Centennial, CO (US)

(73) Assignee: Infoprint Solutions Company, LLC, Boulder, CO (US)

( * ) Notice: Subject to any disclaimer, the term of this patent is extended or adjusted under 35 U.S.C. 154(b) by 34 days.

(21) Appl. No.: 11/405,384

(22) Filed: Apr. 17, 2006

(65) Prior Publication Data

US 2007/0241089 A1 Oct. 18, 2007

(51) Int. Cl.
*H05B 1/00* (2006.01)
*G03G 15/20* (2006.01)

(52) U.S. Cl. ..... 219/216; 219/469; 219/470; 219/471; 399/329; 399/330; 399/331; 399/332; 399/333; 399/334; 399/335; 399/336; 399/337; 399/338; 118/60; 432/60; 432/228; 432/46

(58) Field of Classification Search ..... 219/216, 219/469–71; 118/60; 399/328–338; 432/60, 432/228, 46
See application file for complete search history.

(56) References Cited

U.S. PATENT DOCUMENTS

| | | | | |
|---|---|---|---|---|
| 3,945,726 | A * | 3/1976 | Ito et al. | 399/331 |
| 5,153,411 | A | 10/1992 | Ndebi | |
| 5,724,639 | A | 3/1998 | Tamura et al. | |
| 6,049,692 | A * | 4/2000 | Hwang | 399/333 |
| 6,118,969 | A | 9/2000 | Curry et al. | |
| 6,393,230 | B1 | 5/2002 | Haneda et al. | |
| 6,405,013 | B2 | 6/2002 | Haneda et al. | |
| 2003/0202826 | A1 | 10/2003 | Yokoi et al. | |

* cited by examiner

*Primary Examiner*—Shawntina Fuqua
(74) *Attorney, Agent, or Firm*—Duft Bornsen & Fishman, LLP

(57) ABSTRACT

Provided is a printing device comprising a hot roller having an inside surface and an outside surface. A heating element is present within the hot roller. The inside surface has a first region, wherein the first region is coated with a first type of material. The inside surface has a second region, wherein the second region is coated with the first type of material, and wherein second region is of a different dimension than the first region. The inside surface has a third region, wherein the third region is coated with a second type of material.

10 Claims, 7 Drawing Sheets

ADJUSTMENT OF TEMPERATURE IN A HOT ROLLER

BACKGROUND

1. Field

The disclosure relates to a method and system for the adjustment of temperature in a hot roller.

2. Background

In certain laser printers, a laser draws the printable image on a special light-sensitive optical photo conducting drum. The light sensitive drum collects powdered ink, also referred to as toner, using an electrostatic charge and allows the toner to be transferred to a page of paper. The dry, powdery toner has to be melted to become a permanent image on the page. To melt the toner, the page is rolled between a hot fuser roller, also referred to as a hot roller, and at least one unheated pressure roller, also referred to as a backup roller. One or more infrared lamps, such as halogen lamps, included inside the hot roller may heat the hot roller up to a temperature high enough to melt and fuse the toner to the page.

For example, the IBM* Infoprint* 4100 comprises a continuous forms printing system that has two electrophotographic printers, called engines, which allow printing on both sides of the paper. In the IBM Infoprint 4100, the toner is electrostatically deposited onto a photoconductive drum and then transmitted electrostatically to the paper. The paper then travels between two rollers, a hot roller and a backup roller, which apply heat and pressure respectively to fuse the toner to the paper. In the IBM Infoprint 4100, the page also flows over a preheated platen, where the preheated platen is used to preheat the paper before the paper reaches the hot roller, in order to aid in achieving the necessary paper temperature for the toner to fuse correctly. The hot roller may be an aluminum tube coated with a layer of silicon rubber. There are four internal tungsten quartz filament lamps of different length and position inside the hot roller, which collectively heat the hot roller. The backup roller is also an aluminum tube, but without heating elements. The backup roller applies pressure to fuse the toner to the paper. Due to the soft nature of the silicon rubber coating, when the hot roller and backup roller are in contact, they may form a nip area of approximately 10 mm. This allows for sufficient area and time to fuse the toner to the paper. To prevent the toner from adhering to the hot roller, the hot roller is coated with silicon oil. This is accomplished from a cloth material saturated in the oil. When the printer is running, the cloth is in contact with the hot roller. A smaller positioning roller may be used to optimize the paper direction before the paper proceeds between the hot roller and backup roller.

* IBM and Infoprint are trademarks or registered trademarks of International Business Machines Corporation

SUMMARY OF THE DESCRIBED EMBODIMENTS

Provided is a printing device comprising a hot roller having an inside surface and an outside surface. A heating element is present within the hot roller. The inside surface has a first region, wherein the first region is coated with a first type of material. The inside surface has a second region, wherein the second region is coated with the first type of material, and wherein second region is of a different dimension than the first region. The inside surface has a third region, wherein the third region is coated with a second type of material.

In additional embodiments, the second type of material absorbs less heat from the heating element in comparison with the first type of material. In further embodiments, the first type of material is black paint, and the second type of material is aluminum.

In still further embodiments, the printing device is a first printing device, wherein in the first printing device the differences of temperature between different regions of the outside surface of the hot roller is decreased in comparison to a second printing device in which identical material is used to coat the inside surface of any hot roller in the second printing device.

In certain embodiments of the printing device, the dimensions of the first region, the second region, and the third region are determined based on temperatures profiles measured on the outside surface of the hot roller. In additional embodiments of the printing system, the entire inside surface is coated with the second type of material, and the first type of material is coated over the second type of material on the first and second regions of the inside surface. In further embodiments of the printing device the first region and the second region are located adjacent to two edges of the hot roller.

In yet additional embodiments, the printing device further comprises a toner, wherein the toner is fused to paper by the hot roller, wherein the printing device is a first printing device, and wherein in the hot roller in the first printing device fuses the toner more uniformly over the paper in comparison to a second printing device in which the inside surface of any hot roller in the second printing device is coated with identical material.

Provided is a laser printer, comprising, a hot roller having an inside surface and an outside surface. The hot roller has a heating element within the hot roller. The inside surface of the hot roller is made from a first type of material. A second type of material absorbs heat generated by the heating element better in comparison to the first type of material. The hot roller further comprises a first region of the inside surface, wherein the second type of material coats the first type of material in the first region. The hot roller further comprises a second region of the inside surface, wherein the second type of material coats the first type of material in the second region.

In certain embodiments of the laser printer, a third region of the inner surface is left uncoated. In additional embodiments of the laser printer, dimensions of the first region, the second region, and the third region are determined based on temperature profiles measured on the outside surface of the hot roller. In further embodiments of the laser printer, the first type of material is aluminum and the second type of material is black paint.

In certain embodiments, the laser printer is a first laser printer, wherein in the first laser printer the differences of temperature between different regions of the outside surface of the hot roller is decreased in comparison to a second laser printer in which identical material is used to coat the inside surface of the hot roller.

In additional embodiments of the laser printer, the first region and the second region are located adjacent to two edges of the hot roller.

Provided is a method, wherein a determination is made of the temperature variation across a hot roller in a printing device. A plurality of regions of the hot roller is determined from the temperature variation, wherein temperature in the determined plurality of regions is relatively lower in comparison to other regions of the hot roller. The plurality of regions of the hot roller is coated with a material that allows the coated plurality of regions to absorb more heat in comparison to the other regions of the hot roller.

In certain embodiments of the method, the material is black paint, wherein the hot roller whose plurality of regions has been coated with black paint has more uniform temperature after being coated with black paint. In other embodiments of the method, at least two of the determined plurality of regions are located adjacent to two edges of the hot roller. In further embodiments of the method, areas adjacent to the edges of the hot roller have a lower temperature before the coating of the plurality of regions. In certain embodiments of the method, after the coating of the plurality of regions the differences of temperature between different regions of the hot roller is decreased in comparison to the differences of temperature between the different regions of the hot roller before the coating of the plurality of regions.

BRIEF DESCRIPTION OF THE DRAWINGS

Referring now to the drawings in which like reference numbers represent corresponding parts throughout.

DETAILED DESCRIPTION

In the following description, reference is made to the accompanying drawings which form a part hereof and which illustrate several embodiments. It is understood that other embodiments may be utilized and structural and operational changes may be made.

Electrophotographic printers, such as laser printers, may have non-uniform temperatures across hot rollers included in the printers. The non-uniform temperature may cause incomplete fusing of toner while printing. In certain implementations, the temperature is not uniform across the roller, and the temperature across the roller varies beyond a predetermined threshold. If the temperature of the hot roller is not large enough, the toner may not completely adhere to the paper. On the other hand, if the roller is too hot, the paper may wrinkle.

Poor fusing of toner to paper can occur when using a hot roller fusing system in a laser printer. The poor fusing can occur because the temperature at the edge of the hot roller may be lower than the temperature in the middle, and the lower temperature may not provide adequate heat to fuse the toner at the edges of paper. Certain embodiments allow the temperature at the edges of a hot roller to be made higher at the edges than in the middle. In certain other embodiments, the temperature profile across a hot roller may be made more uniform by painting certain regions of the hot roller with heat absorbent material.

In certain embodiments, the inside surface of the hot roller is painted black to promote radiation heat transfer to the hot roller. In certain embodiments the painting of the inside of the hot roller is varied to enhance radiation heat transfer at the edges of the hot roller, by using a pattern of black painted and unpainted regions.

Figure 1:
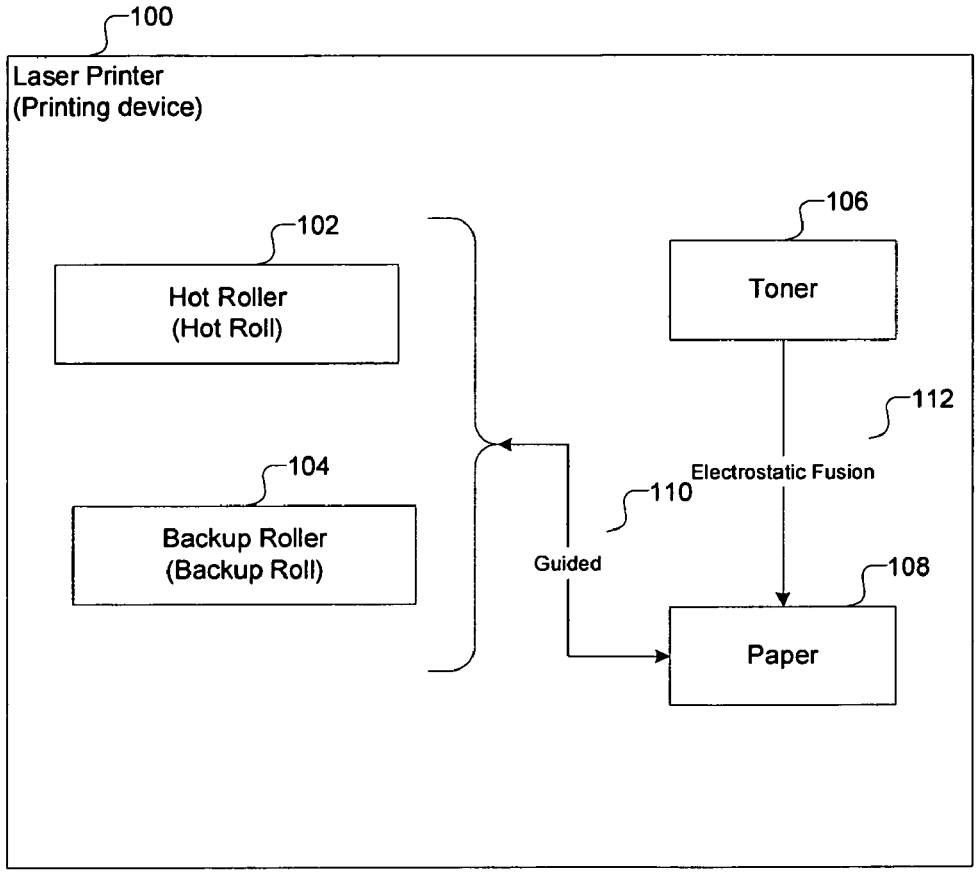
FIG. 1 illustrates a block diagram of a laser printer in accordance with certain embodiments.

FIG. 1 illustrates a block diagram of a printing device, such as a laser printer 100, in accordance with certain embodiments. The laser printer 100 includes a hot roller 102 that is also referred to as a hot roll, and a backup roller 104 that is also referred to as a backup roller. Toner 106 and paper 108 may be added to the laser printer 100 in a manner known in the art.

In certain embodiments, the paper 108 is guided (reference numeral 110) between the hot roller 102 and the backup roller 104. The toner 106 is transferred to the surface of the paper 108 via electrostatic fusion (reference numeral 112).

While a laser printer has been illustrated in FIG. 1, alternative embodiments may be implemented on other printing devices, such as, fax machines, photocopiers, etc. Furthermore, while FIG. 1 shows the paper 108 being guided (reference numeral 110) between the hot roller 102 and the backup roller 104, in alternative embodiments the paper 108 may be guided under or over the hot roller, with or without any backup roller 104 being present.

Figure 2:
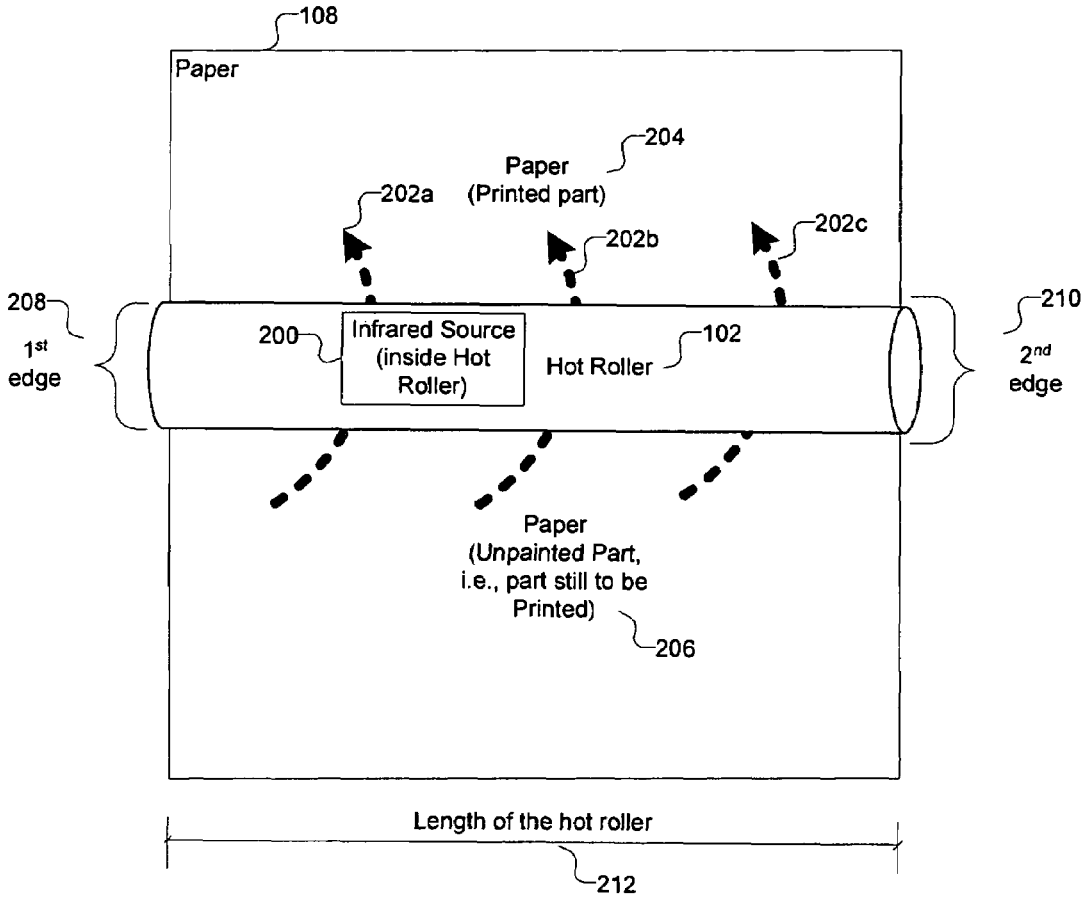
FIG. 2 illustrates a block diagram of a hot roller inside the laser printer, in accordance with certain embodiments.

FIG. 2 illustrates a block diagram of a hot roller 102 inside the laser printer 100, in accordance with certain embodiments.

The hot roller 102 may be shaped in the form of a cylinder. The hot roller 102 may include an infrared source 200, where in certain embodiments the infrared source 100 includes one or more lamps, such as tungsten quartz filament lamps. The one or more lamps that comprise the infrared source 200 are located in one or more hollow cavities inside the hot roller. The infrared source 200 can heat up the hot roller 102.

During the printing process, the paper 108 is guided under the hot roller 102 and the heat applied by the hot roller 102 in association with the pressure applied by the backup roller 104 transfers the toner 106 to the paper 108. The guidance of the paper 108 under the hot roller 102 is indicated in FIG. 2 by the three arcs 202*a*, 202*b*, and 202*c*. As the paper 108 is guided under the hot roller 202, the process of printing takes paces through the transfer of the toner 106 to the paper 108. FIG. 2 shows the region of the paper 108 on which printing has taken place, and this region of the paper 108 on which printing has taken place may be referred to as the printed part 204 of the paper 108. FIG. 2 also shows the region of the paper 108 on which no printing has taken place, and this region of the paper on which no printing has taken place may be referred to as the unprinted part 206 of the paper 108.

The hot roller 102 has two edges, referred to as a first edge 208 and a second edge 210. The two edges 208, 210 may form the two circular ends of the cylinder that comprises the hot roller 102. In certain embodiments, the two edges 208, 210 may be referred to as left and right edges of the hot roller. The length 212 of the hot roller 102 is also shown in FIG. 2, where the maximum width of the paper 108 cannot exceed the length 212 of the hot roller 102. In alternative embodiments, paper that has a width less than the length 212 of the hot roller 102 may be used for printing. In such alternative embodiments one end of the paper 108 may be aligned with the first edge 208 of the hot roller 102, and the other end of the paper may not reach the second edge 210 of the hot roller 102.

Figure 3:
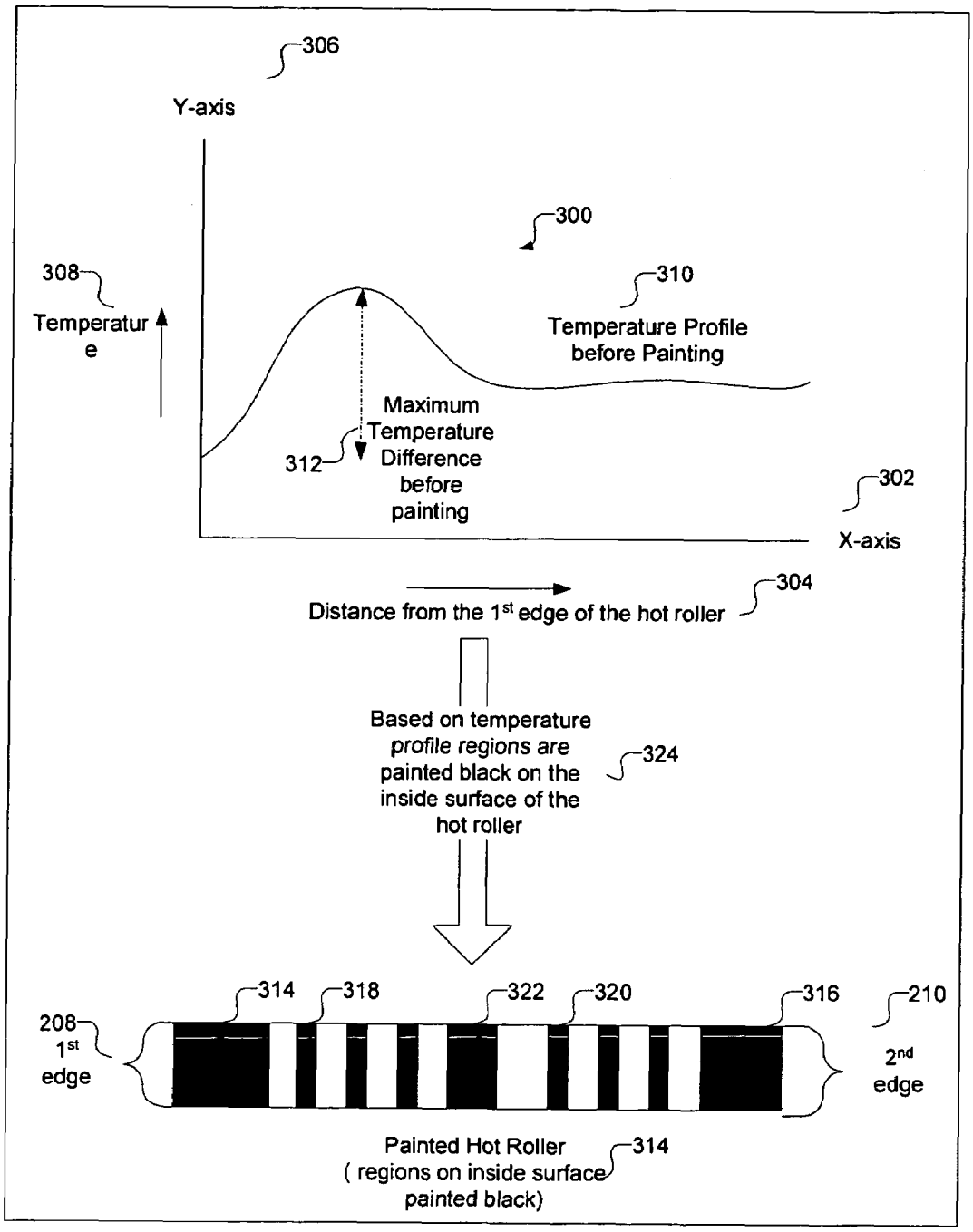
FIG. 3 illustrates a diagram of temperature profile in a hot roller before painting the hot roller and painted regions on the inside surface of the hot roller, in accordance with certain embodiments.

FIG. 3 illustrates a diagram of temperature profile in the exemplary hot roller 102 before the hot roller 102 has been painted, and painted regions on the inside surface of the hot roller 102, in accordance with certain embodiments.

In FIG. 3, the graph 300 shows the temperature profile along the longitudinal axis of the hot roller 102, wherein the longitudinal axis of the hot roller 102 is the longitudinal axis of the cylinder that comprises the hot roller 102.

The X-axis 302 of the graph 300 indicates the distance 304 from the first edge 208 of the hot roller 102, and the Y-axis 306 of the graph 300 indicates the temperature 308 that has been measured on the surface of the hot roller 102 at various distances from the first edge 208 of the hot roller. The maximum distance shown along the X-axis 202 is the length 212 of the hot roller 102.

FIG. 3 shows that the temperature profile 310 along the longitudinal axis of the hot roller 102 as measured by measuring devices that measure temperatures on outside surface of the hot roller 102. The temperature profile 310 may be determined experimentally by operating the laser printer 100 under a variety of experimental conditions. The temperature profile 310 shown in FIG. 3 is an exemplary temperature profile and other embodiments may cause other temperature profiles to be generated.

In the temperature profile 310 the temperature is shown to vary along different distances from the first edge 308 of the hot roller 204. For example, temperatures next to the first edge 208 and the second edge 210 are relatively lower than in certain other regions along the longitudinal axis of the hot roller 102. The maximum temperature difference 312 shown in the graph 300 is the difference between the maximum and minimum temperature along the longitudinal axis on the outside surface of the hot roller 102.

The graph 300 has been drawn for a hot roller 102 in which the inside surface of the hot roller 102 is either not coated or coated with the same type of material. For example, in certain embodiments the inside surface of the hot roller 102 is made of aluminum and is not coated. In other embodiments, the inside surface of the hot roller 102 is made of steel and is coated with aluminum.

As can be observed from the graph 300, the hot roller 102 may exhibit non-uniform temperature on the surface of the hot roller 102. The non-uniform temperature may cause incomplete fusing of toner while printing. For example, if the temperature of the hot roller 102 is not high enough, the toner may not completely adhere to the paper. On the other hand, if the roller is too hot, the paper may wrinkle. The poor fusing can occur because the temperature at the edge of the hot roller may be lower than the temperature in the middle, and the lower temperature may not provide adequate heat to fuse the toner at the edges of the paper 108. A more uniform hot roller temperature may improve the fusing of the toner while printing. Furthermore, the coating on a hot roller may be thermally stressed in the higher temperature regions such that a failure of the coating may limit the useful life of the hot roller. In certain embodiments, a more uniform temperature for the hot roller can also lead to a longer component life for the hot roller.

Certain embodiments allow the temperature at the edges of a hot roller to be made higher at the edges than in the middle. In certain other embodiments, the temperature profile across a hot roller may be made more uniform by painting certain regions of the hot roller with heat absorbent material. For example, certain regions of the inside surface of the hot roller 102 may be painted with black paint, and an exemplary hot roller 314 whose regions in the inside surface have been painted with black paint is shown in FIG. 3. The regions that have been painted with black paint may be the relatively cooler regions as determined from the temperature profile 310.

In the painted hot roller 314, the inside surfaces close to the first edge 208 and the second edge 210 are painted with relatively wide black regions 314, 316 in comparison to relatively narrower black regions, such as black regions 318, 320, 322, that are painted on insides surfaces away from the edges 208, 210 of the hot roller 102. The black paint on the inside surface of the hot roller 102 may allow relatively better absorption of heat radiation from the infrared source 200 and may cause the temperature profile along the longitudinal axis of the hot roller 102 to become more uniform in comparison to the temperature profile 310. For example, if the temperature profile along the longitudinal axis of the hot roller 102 is measured for the painted hot roller 314, the maximum temperature difference between the highest and the lowest temperature along the longitudinal axis of the painted hot roller 314 may be less than the maximum temperature difference 312 before painting the hot roller.

Therefore, FIG. 3 illustrates certain embodiments in which the inside surface of the hot roller 102 is painted black to promote radiation heat transfer to the hot roller 102. In certain embodiments, the painting of the inside of the hot roller 102 is varied to enhance heat transfer at the edges using a pattern of black painted and unpainted regions. In FIG. 3 reference numeral 324 indicates how regions are painted black on the inside surface of the hot roller on the basis of the temperature profile 310.

Figure 4:
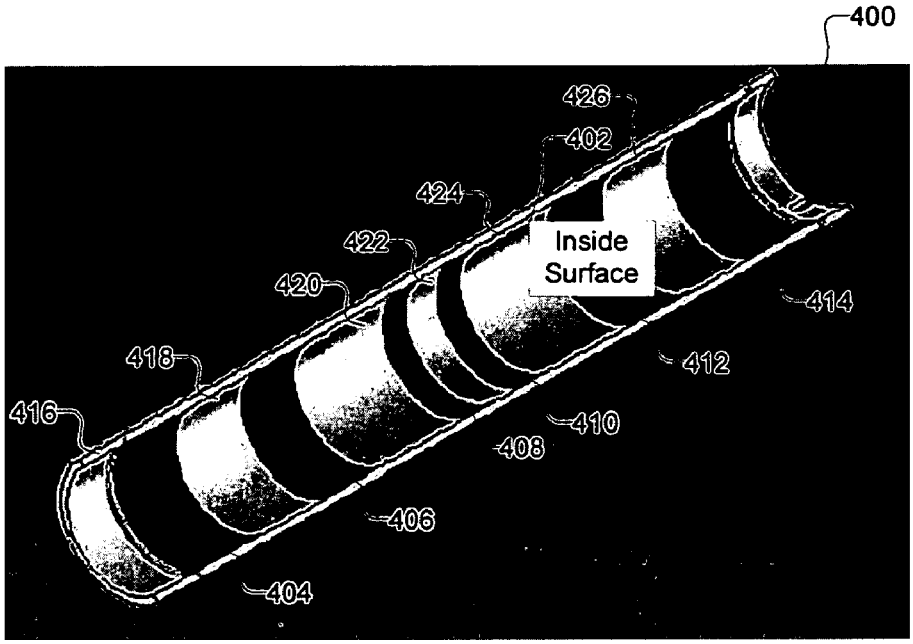
FIG. 4 illustrates painted regions on the inside surface of a hot roller, in accordance with certain embodiments.

FIG. 4 illustrates painted regions on the inside surface of an exemplary painted hot roller 400, in accordance with certain embodiments. In FIG. 4 the inside surface 402 of the hot roller 400 is painted with strips of black paint. For example, in certain embodiments, the black painted regions are the regions indicated by reference numerals 404, 406, 408, 410, 412, 414: The black painted regions 404, 406, 408, 410, 412, 414 may absorb relatively more heat from the infrared source 200 than the unpainted regions 416, 418, 420, 422, 424, 426.

In alternative embodiments, the regions 404, 406, 408, 410, 412, 414 may be coated with or made of a first type of material and the regions 416, 418, 420, 422, 424, 426 may be coated with or made of a second type of material, where the first type of material absorbs more heat from the infrared source 200 in comparison to the second type of material. In certain embodiments, the material that absorbs relatively more heat may be coated over the material that absorbs relatively less heat.

In certain embodiments, the differences of temperature between different regions of the outside surface of the hot roller 400 are decreased in comparison to the situation in which identical material is used to coat the inside surface of the hot roller 400.

Figure 5:
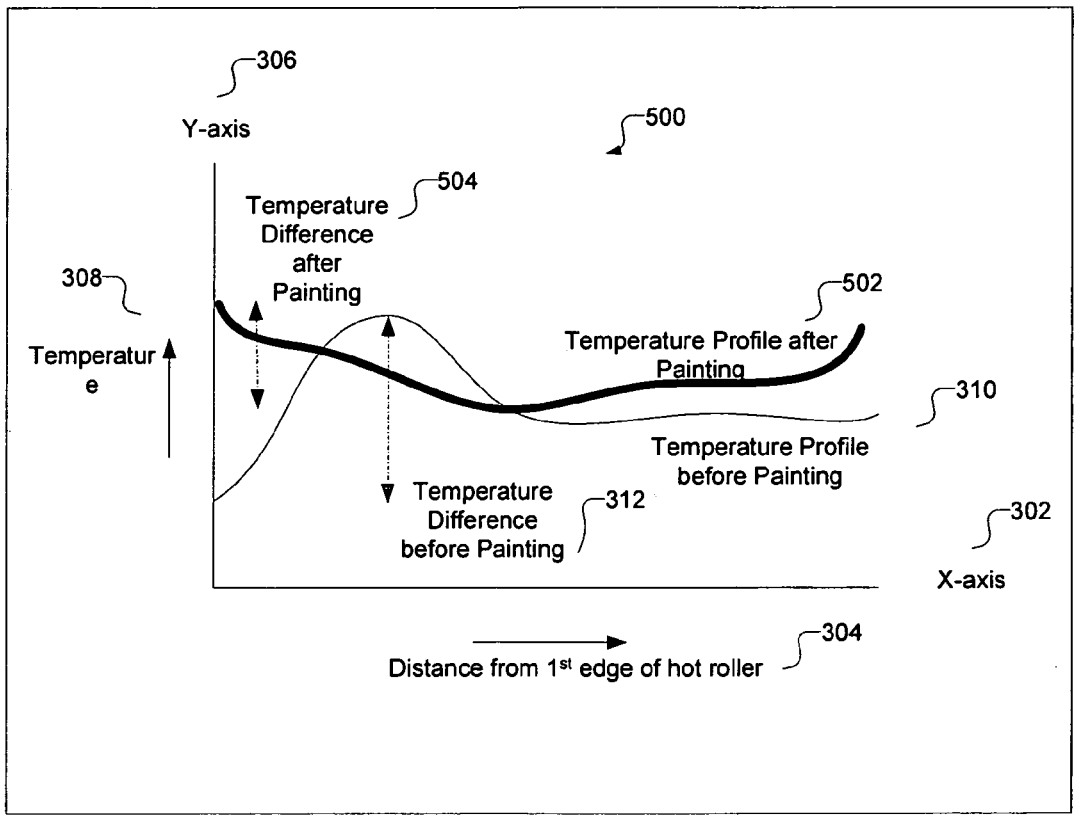
FIG. 5 illustrates temperature profiles in a hot roller before and after painting different regions of the hot roller, in accordance with certain embodiments.

FIG. 5 illustrates temperature profiles in an exemplary hot roller 102 before and after painting different regions of the exemplary hot roller 102, in accordance with certain embodiments.

The graph 500 shown in FIG. 5, indicates the temperature profile 310 before painting the different regions of the hot roller 102, and the temperature profile 504 after painting the different regions of the hot roller 102. It can be seen that the temperature difference 504 after painting the different regions of the hot roller 102 is less than the temperature difference 312 before painting the different regions of the hot roller 102.

Therefore, FIG. 5 illustrates certain embodiments in which after coating with black paint a plurality of regions on the inside surface of the hot roller 102, the differences of temperature between different regions of the hot roller 102 are decreased in comparison to the differences of temperature between the different regions of the hot roller 102 before the coating of the plurality of regions.

Figure 6:
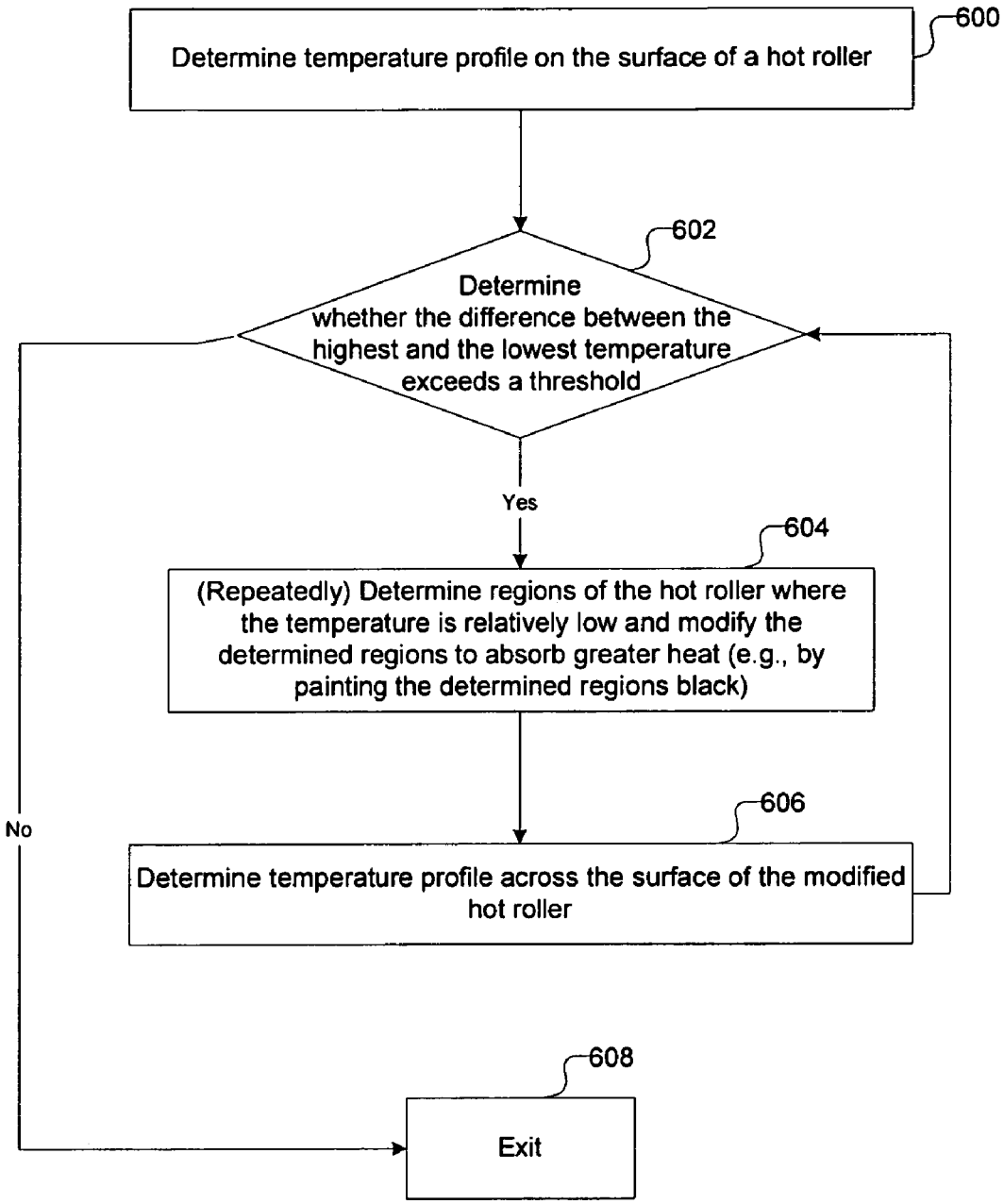
FIG. 6 illustrates a flowchart for determining which regions of the hot roller to point, in accordance with certain embodiments.

FIG. 6 illustrates a flowchart for determining which regions of the hot roller 102 to paint, in accordance with certain embodiments.

Control starts at block 600, wherein the temperature profile 310 on the surface of a hot roller 102 is determined along the longitudinal axis of the hot roller 102. Subsequently, a determination (at block 602) is made as to whether the difference between the highest and the lowest temperature exceeds a threshold. For example, in certain exemplary embodiments the threshold may be a predetermined number of degrees of Celsius and a determination is made as to whether the maximum temperature difference 312 exceeds the predetermined number of degrees of Celsius.

If at block 602, it is determined that the difference between the highest and the lowest temperature exceeds the threshold, then control proceeds to block 604, where repeated determinations are made of the regions of the hot roller 102 in which the temperatures are relatively lower in comparison to other regions and the determined regions are modified to absorb a greater amount of heat from the infrared source 200. The determined regions may be modified by painting the determined regions with black paint. The temperature profile across the surface of the modified hot roller is determined (at block 606) and control returns to block 602.

If at block 602, it is determined that the difference between the highest and the lowest temperature in the temperature profile on the surface of the hot roller does not exceed the threshold, then the process exits (at block 608) because the hot roller that is under consideration in block 602 has a relatively uniform temperature profile whose maximum temperature difference does not exceed the threshold.

Figure 7:
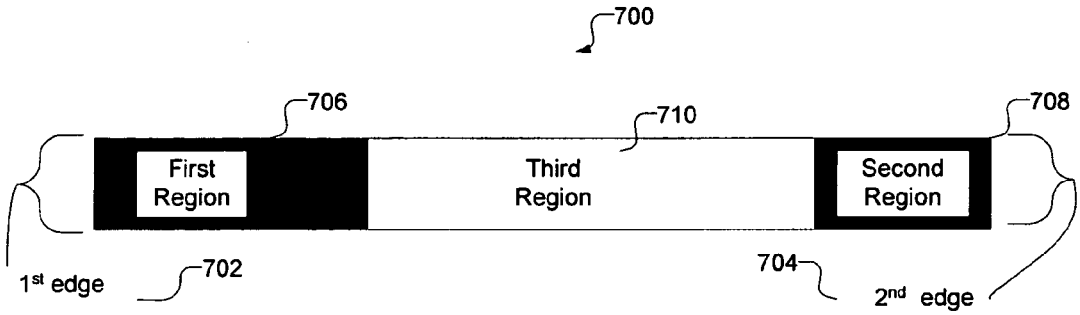
FIG. 7 illustrates a hot roller with a first region, a second region, and a third region, in accordance with certain embodiments.

FIG. 7 illustrates an exemplary hot roller 700 having a first edge 702 and a second edge 704, where the inside surface of the hot roller 700 has a first region 706, a second region 708, and a third region 710, in accordance with certain embodiments. In certain embodiments, the hot roller 700 in additional to the inside surface has an outside surface, and there is a heating element, also referred to as an infrared source, within the hot roller 700. The first region 706 of the inside surface is coated with a first type of material, the second region 708 of the inside surface is also coated with the first type of material, wherein second region is of a different dimension than the first region. The third region of the inside surface is coated with a second type of material, wherein the second type of material absorbs less heat from the heating element in comparison to the first type of material. In certain embodiments, the first type of material is black paint, and the second type of material is aluminum.

In certain embodiments, the dimensions of the first region 706, the second region 708, and the third region 710 are determined based on temperatures profiles measured on the outside surface of the hot roller 700. In further embodiments, the entire inside surface is coated with the second type of material, and the first type of material is coated over the second type of material on the first region 706 and second region 708 of the inside surface. In additional embodiments, the first region 706 and the second region 708 are located adjacent to the two edges 702, 704 of the hot roller 700.

In certain embodiments, the hot roller 700 is included in a first laser printer, wherein in the first laser printer the differences of temperature between different regions of the outside surface of the hot roller 700 is decreased in comparison to a second laser printer in which identical material is used to coat the inside surface of the hot roller.

Certain embodiments do not use heating elements which can be distributed across the roller to increase the heat delivered to the edge of the roller. Certain embodiments may be used in printing system having an existing lamp design or standard lamps where it is not possible to distribute the heating elements. In addition certain embodiments may be used in situations where it may not be possible to locate and distribute heating filaments within a hot roller to produce proper temperature for fusing toner to hot roller. Furthermore, in certain printing systems the paper width may be narrower than the hot roller and the associated heating elements. In such printing systems, the temperature can be too high at one end of the hot roller, and a coating pattern as described in certain embodiments can cause the temperature to become more uniform.

It has been observed experimentally the two edges 706, 708 of the hot roller 102 have a lower temperature in comparison to other regions of the hot roller 102, and one of the reasons may be exposure to air along the two edges 706, 708 of the hot roller 102.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously, in parallel, or concurrently.

When a single device or article is described herein, it will be apparent that more than one device/article (whether or not they cooperate) may be used in place of a single device/article. Similarly, where more than one device or article is described herein (whether or not they cooperate), it will be apparent that a single device/article may be used in place of the more than one device or article. The functionality and/or the features of a device may be alternatively embodied by one or more other devices which are not explicitly described as having such functionality/features. Thus, other embodiments need not include the device itself.

At least certain of the operations illustrated in FIG. 6 may be performed in parallel as well as sequentially. In alternative embodiments, certain of the operations may be performed in a different order, modified or removed.

Furthermore, many of the components have been described in separate modules for purposes of illustration. Such components may be integrated into a fewer number of components or divided into a larger number of components. Additionally, certain operations described as performed by a specific component may be performed by other components.

The structures and components shown or referred to in FIGS. 1-7 are described as having specific types of information and function. In alternative embodiments, the data structures and components may be structured differently and have fewer, more or different fields or different functions than those shown or referred to in the figures.

Therefore, the foregoing description of the embodiments has been presented for the purposes of illustration and description. It is not intended to be exhaustive or to limit the embodiments to the precise form disclosed. Many modifications and variations are possible in light of the above teaching.

What is claimed is:

1. A method of generating a desired first temperature profile on an outside surface a hot fusing roller, the method comprising:

(a) heating an inside surface of the hot fusing roller;

(b) measuring a plurality of locations on the outside surface of the hot fusing roller to determine a second temperature profile;

(c) applying a heat absorption material differentially across the inside surface of the hot fusing roller based on a difference between the second temperature profile and the desired first temperature profile;

(d) measuring the plurality of locations on the outside surface of the hot fusing roller to determine a third temperature profile;

(e) determining if the third temperature profile is substantially the same as the desired first temperature profile; and (f) performing steps (a) through (e) based on determining that the third temperature profile is not substantially the same as the desired first temperature profile.

2. The method of claim 1 wherein applying the heat absorption material further comprises:

applying the heat absorption material to a first region within the inside surface of the hot fusing roller using a first pattern of application; and applying the heat absorption material to a second region within the inside surface of the hot fusing roller using a second pattern of application, wherein the first pattern of application and the second pattern of application are different.

3. The method of claim 1 wherein the heat absorption material includes black paint.

4. The method of claim 1 wherein the desired first temperature profile includes a higher temperature at an end portion of the hot fusing roller as compared to a middle portion of the hot fusing roller.

5. The method of claim 1 wherein the desired first temperature profile includes substantially the same temperature at an end portion of the hot fusing roller as compared to a middle portion of the hot fusing roller.

6. A method of generating a desired first temperature profile on an outside surface a hot fusing roller, the method comprising:

(a) heating an inside surface of the hot fusing roller;

(b) measuring a plurality of locations on the outside surface of the hot fusing roller to determine a second temperature profile;

(c) applying a heat reflection material differentially across the inside surface of the hot fusing roller based on a difference between the second temperature profile and the desired first temperature profile;

(d) measuring the plurality of locations on the outside surface of the hot fusing roller to determine a third temperature profile;

(e) determining if the third temperature profile is substantially the same as the desired first temperature profile; and (f) performing steps (a) through (e) based on determining that the third temperature profile is not substantially the same as the desired first temperature profile.

7. The method of claim 6 wherein applying the heat reflection material further comprises:

applying the heat reflection material to a first region within the inside surface of the hot fusing roller using a first pattern of application; and applying the heat reflection material to a second region within the inside surface of the hot fusing roller using a second pattern of application, wherein the first pattern of application and the second pattern of application are different.

8. The method of claim 6 wherein the heat reflection material includes Aluminum.

9. The method of claim 6 wherein the desired first temperature profile includes a higher temperature at an end portion of the hot fusing roller as compared to a middle portion of the hot fusing roller.

10. The method of claim 6 wherein the desired first temperature profile includes substantially the same temperature at an end portion of the hot fusing roller as compared to a middle portion of the hot fusing roller.

* * * * *